United States Patent [19]

Becker

[11] 4,395,661

[45] Jul. 26, 1983

[54] TIME-VARIABLE CONTROL FOR LAMP INTENSITY

[76] Inventor: William A. Becker, c/o Andrew S. Viger, 900 Milam Bldg., San Antonio, Tex. 78205

[21] Appl. No.: 280,704

[22] Filed: Jul. 6, 1981

[51] Int. Cl.[3] ..... H05B 37/02

[52] U.S. Cl. ..... 315/360; 315/76; 315/208

[58] Field of Search ..... 315/360

[56] References Cited

U.S. PATENT DOCUMENTS

| | | | |
|---|---|---|---|
| 1,665,412 | 4/1928 | Hall | 315/360 |
| 1,964,846 | 7/1934 | Earnshaw | 315/360 |
| 1,972,159 | 9/1934 | Morrison | 315/360 |
| 3,991,343 | 11/1976 | Delpy | 315/360 |

OTHER PUBLICATIONS

"Slow On/Off", Elektor, vol. 4, No. 2, Feb. 1978, pp. 2-17 to 2-19.

"Circuit of the Day", Component Report XIII, Dec. 1978, No. 6, pp. 209-211.

*Primary Examiner*—Harold A. Dixon

*Attorney, Agent, or Firm*—McCamish, Ingram, Martin & Brown

[57] ABSTRACT

A time-variable illumination control apparatus for a lamp permits light intensity to be gradually increased starting at a predetermined time. The intensity control includes a clock-timer to initiate time-variable power supply network. The illumination control apparatus is designed for use on mornings when a user would commonly arise before daylight. By setting the illumination control apparatus to gradually increase the light intensity of a lamp prior to awakening, the lamp simulates sunrise so that the eyes gradually adjust to the light while sleeping. Upon awakening, the eyes are fully adjusted to the light and eye discomfiture from a sudden increase in intensity is avoided.

2 Claims, 3 Drawing Figures

T0: SW1 OPEN
SW2 OPEN

T1: SW1 CLOSED
SW2 OPEN

T2: SW1 OPEN
SW2 CLOSED

T3: SW1 OPEN
SW2 OPEN

TO: SWI OPEN
SW2 OPEN

T1: SWI CLOSED
SW2 OPEN

T2: SWI OPEN
SW2 CLOSED

T3: SWI OPEN
SW2 OPEN

TIME-VARIABLE CONTROL FOR LAMP INTENSITY

BACKGROUND OF THE INVENTION

The present invention relates to the field of intensity controls for lamps.

A common problem for people awakening before daylight (primarily in the winter months) is that the eyes are unaccustomed to light. When a light is turned on, activity is limited, albeit momentarily, while the eyes adjust to the sudden increase in light intensity. This adjustment period can be annoying or even discomforting.

Eye adjustment to light after awakening is not required when a person rises after daylight because sufficient light filters through closed eyelids to allow the eye to gradually become accustomed to light. Upon awakening, the eyes are adjusted and eye strain or discomfiture is avoided.

Of course, variable intensity controls for lamps are well known. Also, such controls have been used to simulate normal sunrise and sunset in underground or windowless houses, thereby simulating a normal environment for those in the house. Typically, such time-variable intensity controls have been used to gradually illuminate (and darken) a simulated window scene, rather than adjust the intensity of the house lights.

Heretofore, however, such time-variable intensity controls have not been used in the context of avoiding the eye adjustment problem discussed above. That is, such intensity controls have not been used to alleviate the problem of eye discomfiture from suddenly turning on a light after a pre-dawn awakening.

OBJECTS AND SUMMARY OF THE INVENTION

A general object of the present invention is to provide a time-variable illumination control apparatus to enable a person to automatically simulate gradual sunrise over a given time period prior to awakening. To this end, a specific object of the present invention is to provide an illumination control apparatus that can be set by a user to gradually increase the light intensity of the lamp over a given period prior to awakening, thereby permitting the eyes to gradually become accustomed to light.

Briefly, to accomplish these objects and others readily apparent to those of ordinary skill in the art, the present invention includes a timing means (such as a clock) for controlling a switch network. When activated by the timing means, the switch network couples AC power to a time-variable illumination control apparatus that gradually increases power to a lamp over a predetermined time interval.

The illumination control apparatus permits a user to cause the illumination in a room to gradually increase over a given interval prior to awakening. By gradually increasing light intensity, the users eyes become adjusted to the light while still sleeping, thereby avoiding the adjustment period normally needed to acclimate the eyes to a sudden increase in light intensity, and the resulting eye strain or discomfiture.

BRIEF DESCRIPTION OF THE DRAWINGS

A more complete understanding of the present invention can be had by reference to the following detailed description of a preferred embodiment when considered in conjunction with the accompanying drawings, in which.

DESCRIPTION OF THE PREFERRED EMBODIMENT

The time-variable intensity control apparatus of the present invention permits the user to gradually increase room illumination prior to awakening, thereby permitting gradual eye adjustment to light and avoiding eye strain or discomfiture from a sudden increase in intensity.

Figure 1:
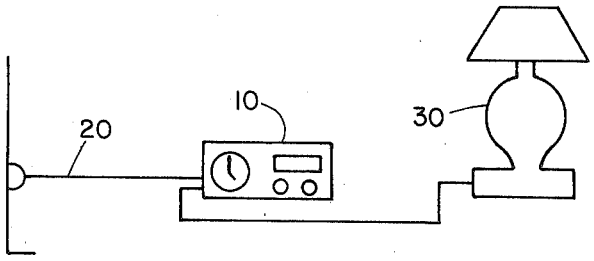
FIG. 1 is a schematic view illustrating the concept of the present invention.
Figure 2:
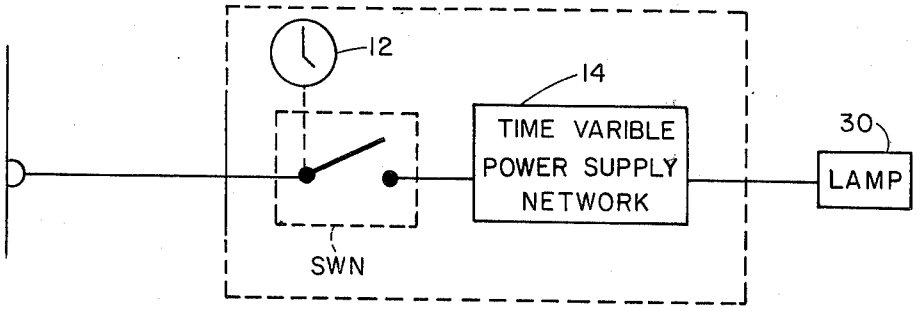
FIG. 2 is a block diagram of the time-variable illumination control apparatus of the present invention.

Referring to FIGS. 1 and 2, the present invention can be used in conjunction with an otherwise standard clock radio 10. Clock radio ten receives standard 110 volt house power via a line 20. A lamp 30 is coupled to clock radio 10. At a preselected time, a clock 12 activates a switch network SWN, causing it to supply alternating power signals to a time-variable power supply network 14. Illumination control network 14 is responsive to these power signals to gradually increase the intensity of light over a predetermined time period, thereby gradually increasing room illumination.

The principal advantage of the time-variable illumination control apparatus of the present invention is that is provides a means to avoid eye discomfiture from a sudden increase in light intensity. It permits a person awakening prior to daylight hours to cause room illumination to gradually increase, thereby allowing his eyes to gradually become accustomed to light while sleeping. Because room illumination is gradually increased (simulating actual sunrise), sleep is not disturbed.

Figure 3:
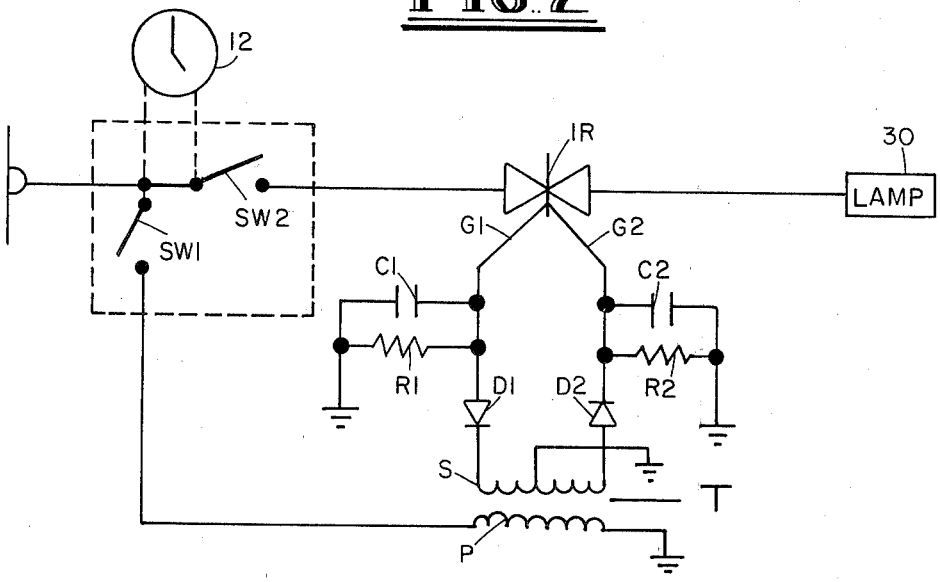
FIG. 3 is a circuit diagram indicating one embodiment for a time-variable power supply network.

A preferred variable power supply network using a triac is shown in FIG. 3. A triac TR is coupled between switch network SWN and lamp 30. The triac includes two gate control leads, G1 for controlling negative voltages and G2 for controlling positive voltages. Gate control G1 is coupled through a capacitor C1 and through a resistor R1 to ground. Capacitor C1 is coupled through a diode D1 to the secondary winding S of transformer T. Similarly, gate control G2 is coupled through a capacitor C2 and through a resistor R2 to ground, and through a diode D2 to secondary winding S. Secondary winding S is center tap grounded, while the primary winding P of transformer T is coupled between switch network SWN and ground.

In operation, switch network SWN initially supplies power signals through primary winding P, inducing a step down current in secondary winding S. During negative voltage swings, current is supplied through diode D1 to charge capacitor C1 to a predetermined maximum voltage. Likewise, during positive voltage swings, current is supplied through diode D2 to charge capacitor C2. After a predetermined time, switch network SWN decouples power signals from transformer T, and couples power to triac TR. Initially, because capacitor C1 and C2 are charged to their maximum voltages, gate controls G1 and G2 keep the triac in an off condition for the maximum portion of its control cycle (typically 95% of the power cycle), so that the lamp will be at its lowest level of illumination. Capacitors C1 and C2 gradually discharge through, respectively, resistors R1 and R2, reducing the voltages at gate controls G1 and G2, and thereby gradually increasing the power coupled through triac TR to the lamp. In this manner, lamp illumination is gradually increased over a predetermined time interval.

Switch networks capable of switching power to intensity control unit 14 or also well known. Either electromechanical or transistor-based switch networks can be used. Ilustratively, for the variable power supply network 14 unit, switch network SWN performs two switching functions, represented by switches SW1 and SW2. Initially, both switches are open so that no power is supplied to either lamp 30 or variable power supply network 14. At a preselected time, clock 12 provides a switch control signal to close switch SW1, supplying alternating current signals through primary winding P of transformer T to charge capacitors C1 and C2. After a predetermined time (sufficient to fully charge the capacitors), switch SW1 is closed and switch SW2 is opened, decoupling transformer and coupling power to triac TR. In the manner described above, the triac's on-cycle is gradually increased to gradually increase power supplied to lamp 30, thereby gradually increasing lamp illumination.

While the invention has therefore been described with respect to a preferred embodiment, other embodiments and modifications of the invention will readily come to those of ordinary skill in the art having the benefit of the teachings presented in the foregoing description of the preferred embodiment and the drawings. Those skilled in the art will, therefore, recognize that the invention is not limited to the preferred embodiment, but rather that the limits of the invention are to be interpreted only in conjunction with the appended claims.

The embodiments of the invention in which an exclusive property or privilege is claimed are defined as follows:

1. A time-variable illumination control apparatus for gradually increasing light intensity prior to awakening to avoid eye discomfiture from a sudden increase in light intensity, comprising:

a. a light;

b. timing means for providing switch control signals;

c. a switch network responsive to said switch control signals to supply alternating current signals during preselected times; and d. a variable power supply including:

(i) a triac coupled between said switch network and said light; said triac having positive and negative gate control leads;

(ii) positive and negative charging means responsive to switch control signals from said switch network to provide, respectively, positive and negative voltages during preselected times;

(iii) a positive gate control network consisting of parallel connected capacitor and resistor coupled to said positive gate control lead and to said positive charging means; and (iv) a negative gate control network consisting of a parallel connected capacitor and resistor coupled to said negative gate control lead and to said negative charging means;

e. said positive and negative gate control networks being responsive to, respectively, positive and negative voltages from said respective charging means such that respective capacitors are charged during preselected times;

f. said positive and negative gate control network providing gating voltages gradually decreasing in amplitude to, respectively, said positive and negative gate leads to said triac, such that the alternating current through said triac to said light gradually increases;

such that the illumination from said light is gradually increased prior to awakening to avoid the need for eye adjustment to sudden increases in light intensity, thereby avoid resulting eye discomfiture.

2. The time-variable illumination control apparatus defined in claim 1 wherein said positive and negative charging means comprise a transformer having (a) a primary winding coupled to receive alternating current signals during preselected times from said switch network, and (b) a secondary winding, center tap grounded, having a positive end coupled through a diode to said positive gate control network and a negative end coupled through a diode to said negative gate control network.

* * * * *